US005167356A

United States Patent [19]

Williams

[11] Patent Number: 5,167,356

[45] Date of Patent: Dec. 1, 1992

[54] EMERGENCY TELEPHONE-TOKEN DEVICE

[76] Inventor: Carl A. Williams, 6730 N. 17th Ave., No. 208, Phoenix, Ariz. 85015

[21] Appl. No.: 753,307

[22] Filed: Aug. 30, 1991

[51] Int. Cl.[5] ..... A45F 3/02; A44C 25/00

[52] U.S. Cl. ..... 224/202; 224/251; 206/0.80; 63/23

[58] Field of Search ..... 224/202, 218, 220, 205, 224/257, 249, 251; 206/0.81, 0.8, 0.84; 24/3 B; 63/23

[56] References Cited

U.S. PATENT DOCUMENTS

| | | | |
|---|---|---|---|
| D. 175,981 | 11/1955 | Rubeck | D11/78.1 |
| 2,358,262 | 9/1944 | Suess | 206/38 |
| 3,044,606 | 7/1962 | Frosh | 206/0.84 |
| 3,964,187 | 6/1976 | Stumpf | 63/23 |

*Primary Examiner*—Henry J. Recla
*Assistant Examiner*—David J. Walczak
*Attorney, Agent, or Firm*—Antonio R. Durando; Harry M. Weiss

[57] ABSTRACT

An emergency telephone-token device consisting of a telephone token encased in a clamping ring with a link and hook for attachment to a bracelet or necklace chain. The ring is made of resilient material and features an elliptical inner surface with a major axis slightly larger and a minor axis slightly smaller than the diameter of the encased token. The token is mounted and released simply by forcing it in and out of the ring against the pressure exerted by the portions of the inner surface corresponding to the minor axis. Such inner surface is flat and approximately twice the thickness of the token, so as to provide sufficient area of contact for it to remain in place when subjected to the impacts of normal wear. By pressing against it, a child can easily release the token from the device and use it for an emergency phone call. Another embodiment of the device includes a groove within the inner surface of the ring to further stabilize the token in place.

8 Claims, 1 Drawing Sheet

EMERGENCY TELEPHONE-TOKEN DEVICE

BACKGROUND OF THE INVENTION

1. Field of the Invention

This invention pertains to the general field of holders for coins, charms, and similar objects. In particular, it provides a new and improved holder for carrying a telephone token that is easily available for use in an emergency.

2. Description of the Prior Art

It is commonplace for adults to give children a quarter when they leave home with instructions to save it for a phone call in case of an emergency. The problem is always how to ensure that the child will not lose the quarter in the meantime. Accordingly, people resort to hiding it in a special pocket, a shoe, or other supposedly safe place. Usually, though, the quarter is lost by the time it becomes needed.

Therefore, it would be very desirable to have a secure coin or token holder that could be worn on a chain and that made it possible for a child to easily free the coil for use when needed.

Conventional hardware exists for carrying coins, stones and charms on a chain, either on a bracelet or a necklace, but it always involves some form of permanent fastener to hold the ornamental piece in place. The result is that the piece cannot be released without the use of a tool or, in the case of spring-loaded snap-type latches, without the strength of an adult to open the latch. Thus, these holders are not suitable for the purposes intended here, which mainly are to provide a coin or token holder with a quick release for use, especially by a child, to make a phone call in case of an emergency.

For example, U.S. Pat. No. 2,358,262 to Suess (1944) describes a bill clip that in one embodiment includes a clamping ring for encasing a coin for ornamental purposes as well as for providing extra money for emergencies. The coin is held in place by the pressure exerted around its rim by a fastener tied to two open ends of the ring. Therefore, the fastener has to be opened before the coin can be released, requiring the kind of effort that this invention is designed to eliminate.

BRIEF SUMMARY OF THE INVENTION

It is therefore an objective of this invention to provide a device for securely and conveniently carrying an emergency telephone token strapped to the body of a user, either as a bracelet or a necklace.

Another objective of the invention is to provide a device that holds the token securely in place when subjected to the impacts of normal use, especially by children, and yet permits the prompt and easy extraction of the token when needed.

Still another goal of the invention is the realization of the above mentioned objectives with simple and inexpensive hardware.

In accordance with these and other objectives, the method and apparatus of this invention consist of a telephone token encased in a clamping ring with a link and hook for attachment to a bracelet or necklace chain. The ring is made of resilient material and features an elliptical inner surface with a major axis slightly larger and a minor axis slightly smaller than the diameter of the encased token. The token is mounted and released simply by forcing it in and out of the ring against the pressure exerted by the portions of the inner surface corresponding to the minor axis. Such inner surface is flat and approximately twice the thickness of the token, so as to provide sufficient area of contact for it to remain in place when subjected to the impacts of normal wear. By pressing against it, a child can easily release the token from the device and use it for an emergency phone call. Another embodiment of the device includes a groove within the inner surface of the ring to further stabilize the token in place.

Various other purposes and advantages of the invention will become clear from its description in the specification that follows, and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose only some of the various ways in which the invention may be practiced.

DETAILED DESCRIPTION OF INVENTION

The heart of this invention lies in the simple geometry of the inner surface of the clamping ring, which makes it possible to mount and release a telephone token or coin without the need to deal with a fastening clamp. Thus, the main objective of providing a token holder for easy and convenient use by a child is met.

Figure 1:
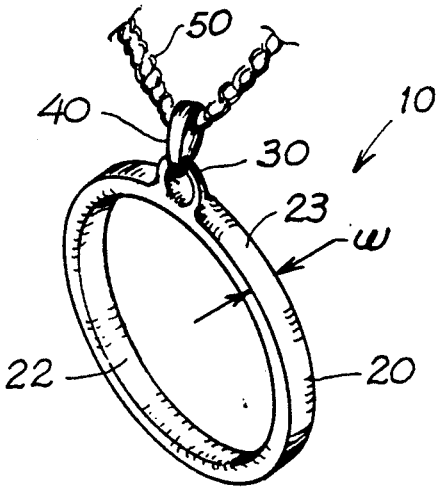
FIG. 1 is a perspective view of the device of the invention.

Referring to the drawings, wherein the same reference numbers and symbols are used throughout to designate like parts, FIG. 1 illustrates the general configuration of the token holder 10 of this invention before a token is mounted in it. The holder comprises a clamping ring 20 that incorporates a link 30 on the outer surface 23 of the ring for attachment to conventional hook 40 looped therethrough and threaded by a chain 50 of a necklace or bracelet (shown only in part). Although the holder could be pinned to clothes or to personal belongings through the link 30, it is mainly intended for use with a necklace or bracelet, so that it can be continuously worn by a user and be always available in case of need.

Figure 2:
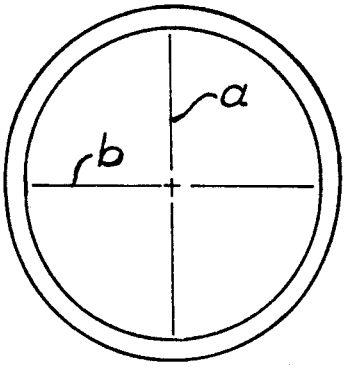
FIG. 2 is a schematic representation of the geometry of the ring of the invention, illustrating its elliptic shape.

The ring 20 comprises a generally flat and circular inner surface 22 that defines a clamping surface for the normally circular telephone token of the invention. As illustrated in schematic form in FIG. 2, the precise geometry of the inner surface 22 (and therefore also of the ring 20) is slightly off the shape of a perfectly circular ring. Specifically, the ring 20 features an elliptical shape with the inner surface 22 having a major axis a slightly larger than the diameter of the token and minor axis b slightly smaller than that diameter. In practice, the token used in the United States is a quarter coin and the generally circular ring 20 is selected with a diameter a few thousandths of an inch larger that the diameter of a quarter; then, it is slightly deformed to assume the elliptical characteristics just described. Of course, the same result can be achieved by stamping or otherwise forming the ring directly in its final elliptic shape.

Figure 4:
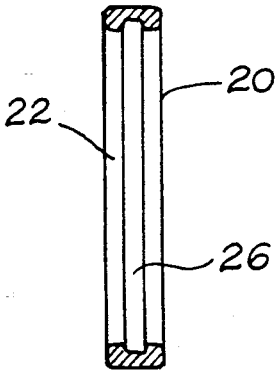
FIG. 4 is a cross-sectional view of the ring of the invention in an embodiment including a retention groove.
Figure 3:
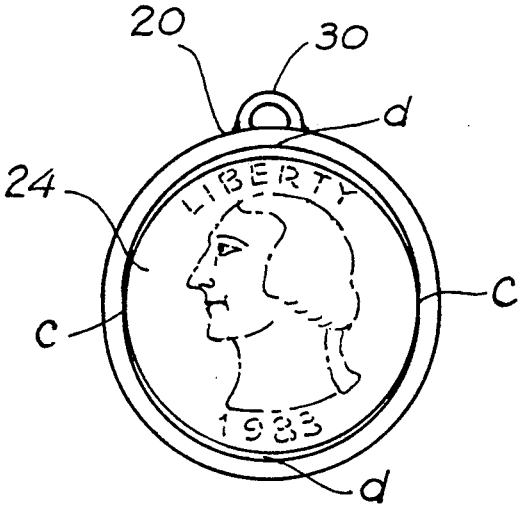
FIG. 3 is an elevational view of the invention wherein the telephone token consists of a U.S. coin.

The ring 20 consist of a continuous shank constructed in a single piece. The material used for the ring must be resilient enough to permit the insertion of the token within its perimeter by pressure fitting the token against the inner surface 22 at the points corresponding to the minor axis b. As the rim of the token penetrates and presses against the inner surface of the ring, the ring conforms to the shape of the circular token and provides a frame within which the token is firmly encased. As shown in FIG. 3, which illustrates a token consisting of a U.S. quarter coin 24, the coin and the inner surface 22 are in forced contact in the areas near points c (corresponding to the location of the minor axis b) as a result of the expansion of the minor axis to accommodate the coin. This contact provides frictional resistance to movement that holds the coin in place. Obviously, no contact exists in the areas near points d corresponding to the major axis a, but the friction produced by the areas of contact is sufficient to ensure the stability of the coin. In order to provide sufficient surface for contact, the width w (shown in FIG. 1) of the ring 20 is preferably at least twice as large as the width of the token used. In the case of a quarter, a width of approximately $\frac{1}{8}$ of an inch has proven to provide very stable support during normal use. As illustrated in the cross-sectional view of FIG. 4, although it has been found not to be necessary to practice the invention, a retention groove 26 can be added to the inner surface 22 to provide an inset for more closely engaging the framed token. This groove could run along the entire circumference of the inner surface or just along the areas of expected contact (corresponding to the minor axis).

It is found that a token can easily be inserted by anyone into a holder constructed according to the parameters described above simply by edging one side of the token against the inner surface 22 and by pushing the other side until it slides in place against the pressure provided by the elliptical shape of the surface. It is also found that a child can easily release the token by pushing on it while holding the ring still. Thus, an inexpensive and convenient device is provided for carrying a telephone token, such as a quarter coin, for immediate availability in case of need. The token can be released without the use of any tool, so that a child can quickly take advantage of it in an emergency.

While the invention is described in terms of a device for holding a circular token or coin, it is obvious that the same principle could be extended to applications involving tokens with other geometric shapes. The general notion of providing retaining pressure by mounting the token into a slightly deformed frame would still apply. For example, if a rectangular token were involved, a slightly rhomboidal frame would achieve the same result.

Therefore, it is understood that many equivalent devices are possible within the scope of the present invention, with different configurations of the clamping ring depending on the specific telephone token of interest. Thus, various changes in the details, steps and materials that have been described may be made by those skilled in the art within the principles and scope of the invention herein illustrated and defined in the appended claims. While the present invention has been shown and described herein in what is believed to be the most practical and preferred embodiment, it is recognized that departures can be made therefrom within the scope of the invention, which is therefore not to be limited to the details disclosed herein, but is to be accorded the full scope of the claims so as to embrace any and all equivalent apparatus and methods.

I claim:

1. A device for holding a telephone token, comprising, in combination:

(a) a circular telephone token;

(b) an elliptical-shape clamping ring, having an inner surface with a major axis slightly larger than the diameter of said token and a minor axis slightly smaller than said diameter, wherein said token is inserted; and (c) a link, attached to the outer surface of said clamping ring, for securing the device for convenient access by a user.

2. The device described in claim 1, further comprising;

(d) a hook, looped around said link; and (e) a chain, threaded through said hook.

3. The device described in claim 1, further comprising:

(f) a retention groove along said inner surface of said elliptical-shape clamping ring.

4. The device described in claim 1, wherein said telephone token is a United States quarter coin.

5. A method for carrying a circular telephone token fastened to a user's body or garment for ready availability in case of need, comprising the following steps:

(a) providing a telephone token;

(b) providing an elliptical-shape clamping ring, having an inner surface with a major axis slightly larger than the diameter of said token and a minor axis slightly smaller than said diameter;

(c) pressure fitting said token into said clamping ring; and (d) providing a link, attached to the outer surface of said clamping ring, for securing the device for convenient access by the user.

6. The method described in claim 5, further comprising the following steps:

(e) providing a hook, looped around said link;

(f) providing a chain, threaded through said hook; and (g) wearing said chain on said user's body.

7. The method described in claim 5, further comprising the step of:

(h) providing a retention groove along said inner surface of said elliptical-shape clamping ring.

8. The method described in claim 5, wherein said telephone toke is a United States quarter coin.

* * * * *